US007218280B2

(12) United States Patent
Annamaa et al.

(10) Patent No.: US 7,218,280 B2
(45) Date of Patent: May 15, 2007

(54) ANTENNA ELEMENT AND A METHOD FOR MANUFACTURING THE SAME

(75) Inventors: Petteri Annamaa, Oulunsalo (FI); Matti Niemi, Arkkukari (FI); Kimmo Antila, Kiviniemi (FI); Ilkka Niemela, Oulunsalo (FI)

(73) Assignee: Pulse Finland Oy, Kempele (FI)

( * ) Notice: Subject to any disclaimer, the term of this patent is extended or adjusted under 35 U.S.C. 154(b) by 58 days.

(21) Appl. No.: 11/089,636

(22) Filed: Mar. 25, 2005

(65) Prior Publication Data

US 2005/0237243 A1 Oct. 27, 2005

(30) Foreign Application Priority Data

Apr. 26, 2004 (FI) ..... 20040584

(51) Int. Cl.
*H01Q 1/38* (2006.01)

(52) U.S. Cl. ..... 343/700 MS

(58) Field of Classification Search ..... 343/700 MS, 343/702, 846, 848

See application file for complete search history.

(56) References Cited

U.S. PATENT DOCUMENTS

| | | | | |
|---|---|---|---|---|
| 6,061,028 | A | 5/2000 | Sakata | 343/702 |
| 6,788,257 | B2 * | 9/2004 | Fang et al. | 343/700 MS |
| 6,924,770 | B2 * | 8/2005 | Carpenter et al. | 343/702 |
| 6,927,730 | B2 * | 8/2005 | Tang et al. | 343/700 MS |
| 2004/0257285 | A1 * | 12/2004 | Quintero Illera et al. | 343/702 |

FOREIGN PATENT DOCUMENTS

| | | |
|---|---|---|
| EP | 0 575 211 | 12/1993 |
| EP | 1336222 | 8/2003 |
| EP | 1 414 106 | 4/2004 |
| SE | 509640 | 12/1997 |
| SE | 518 988 | 9/2002 |

* cited by examiner

*Primary Examiner*—Hoang V. Nguyen
*Assistant Examiner*—Ephrem Alemu
(74) *Attorney, Agent, or Firm*—Darby & Darby

(57) ABSTRACT

A radiating antenna element intended for small-sized radio devices and a method for manufacturing the same. The element (300) is manufactured of a plate comprising a dielectric substrate coated with conductive material on one side. The radiating conductor branches corresponding to the operating bands of the antenna are formed on the plate by removing the conductive coating by laser narrowly from the border line of the area (330) between the designed conductor branches. The conductor area confined by the created border groove can be used as a parasitic additional radiator. If needed, the conductor area confined by the border groove (331) can also be split into a number of small conductor areas (CA1, CA2), in order to make sure that the conductor area does not radiate or have any substantial effect on the coupling between the radiating conductor branches. A relatively wide area "invisible" on the operating frequencies of the radiating branches of the antenna can be formed between the branches by the customary laser technique. This means lower manufacturing costs compared to the use of the etching process, and the creation of problem waste is also avoided.

10 Claims, 4 Drawing Sheets

ANTENNA ELEMENT AND A METHOD FOR MANUFACTURING THE SAME

The invention relates to a radiating antenna element intended particularly for small-sized radio devices. The invention also relates to a method for manufacturing an antenna element according to it.

BACKGROUND OF THE INVENTION

An internal antenna is generally used in small-sized radio devices, such as mobile phones, in order to avoid a part protruding from the cover of the device. Internal antennas are usually planar antennas, because they have relatively good electric properties. A planar antenna comprises a radiating plane and a ground plane parallel with it. The planes are generally connected to each other by a short-circuit conductor because of the matching of the antenna. The structure is dimensioned so that it functions as a resonator at the operating frequency, which is a prerequisite for effective radiation. In modern mobile stations it is a normal requirement that the antenna must operate on two different frequency bands, in which case two resonators are also required. This requirement is met by dividing the radiating plane into two branches of different lengths by means of a non-conductive slot or area. Together with the ground plane and a medium, each branch forms a resonator, the natural frequency of which is arranged at one operating band of the radio device.

The radiating plane can be a separate metal sheet, in which case its slot is formed by cutting while the whole plane is cut from a larger sheet. Saving of material is achieved by manufacturing the radiating plane of thin metal foil. Then the radiating plane cut from the foil is, for example, glued onto the antenna's dielectric frame or onto the inner surface of the cover of a mobile station. The difficulty is to make the shape of the foil element remain exactly right during fastening. Even a relatively small change in the dimensions of especially the non-conductive area of the plane impairs the characteristics of the antenna significantly. The risk of changing the shape of the foil element is avoided if a dielectric plate coated by a metal foil is used for manufacturing the antenna. The desired radiator pattern is formed on the surface of the plate by etching away the surplus parts from the coating. The resulting antenna element is then fastened at a certain distance from the ground plane.

FIG. 1 shows a radiating antenna element 100 manufactured by the known method described above. It comprises a dielectric substrate 110 and a radiating plane 120, which is a conductor layer on the surface of the substrate. The radiating plane has an antenna feed point FP and a short-circuit point SP close to each other. From the latter, the radiating plane is directly connected to the ground plane when the antenna element is installed on place. The non-conductive area 130 starts from the same edge of the element beside which the feed point and the short-circuit point are, and divides the radiating plane into two conductor branches as seen from the short-circuit point SP. The first conductor branch 221 comprises the peripheral areas of the plane, forming a pattern resembling the letter C. The second, shorter conductor branch 222 comprises the inner area of the plane. The lower operating band of the antenna is based on the first conductor branch, and the upper operating band of the antenna is based on the second conductor branch. The antenna element has been cut to such a shape that it follows the inner space of the end part of the radio device in question. FIG. 1 shows the outline COV of the end part.

The non-conductive area 130 of the antenna element 100 has been formed by removing part of the conductive coating of the substrate by etching. The chemicals needed in the process cause a considerable cost in production. This drawback is emphasized if the area between the conductor branches is made relatively wide in order to increase the bandwidths of the antenna. Besides, the chemicals used are environmental poisons, the disposal of which causes additional costs. In principle, it could also be used laser for removing the conductor material in the known manner. However, laser suits well for making very narrow slots only. Removing a relatively wide conductor area would thus be impractical, i.e. expensive, and it would also impair the mechanical and electrical characteristics of the dielectric plate used as a substrate.

SUMMARY OF THE INVENTION

The purpose of the invention is to reduce the mentioned drawbacks of the prior art. The antenna element according to the invention is characterized in what is set forth in the independent claim 1. The method according to the invention is characterized in what is set forth in the independent claim 7. Some preferred embodiments of the invention are set forth in the other claims.

The basic idea of the invention is the following: The radiating element of a multiband planar antenna is manufactured of a plate, which comprises dielectric substrate by one side coated with conductive material. The radiating conductor branches corresponding to the operating bands of the antenna are formed by removing the conductor coating narrowly from the border line of the area between the designed conductor branches. The conductor area confined by the created border groove can be used as a parasitic additional radiator. If needed, the conductor area confined by the border groove can also be split into a number of small conductor areas, in order to make sure that the conductor area does not radiate or have any substantial effect on the coupling between the radiating conductor branches. The removal of the conductive coating is preferably carried out by laser.

The invention has the advantage that a relatively wide area "invisible" at the operating frequencies of the radiating branches of the antenna can be formed between the branches by the customary laser technique. This means lower manufacturing costs compared to the use of the etching process. In addition, the cost of problem waste handling is avoided, which sort of wastes are the chemicals released in the etching process. The invention also has the advantage that the conductor area remaining between the radiating branches can be utilized as an additional radiator on the frequency range of 2.4 GHz, for example.

BRIEF DESCRIPTION OF THE DRAWINGS

In the following, the invention will be described in more detail. Reference will be made to the accompanying drawings, in which.

DETAILED DESCRIPTION OF THE INVENTION

Figure 1:
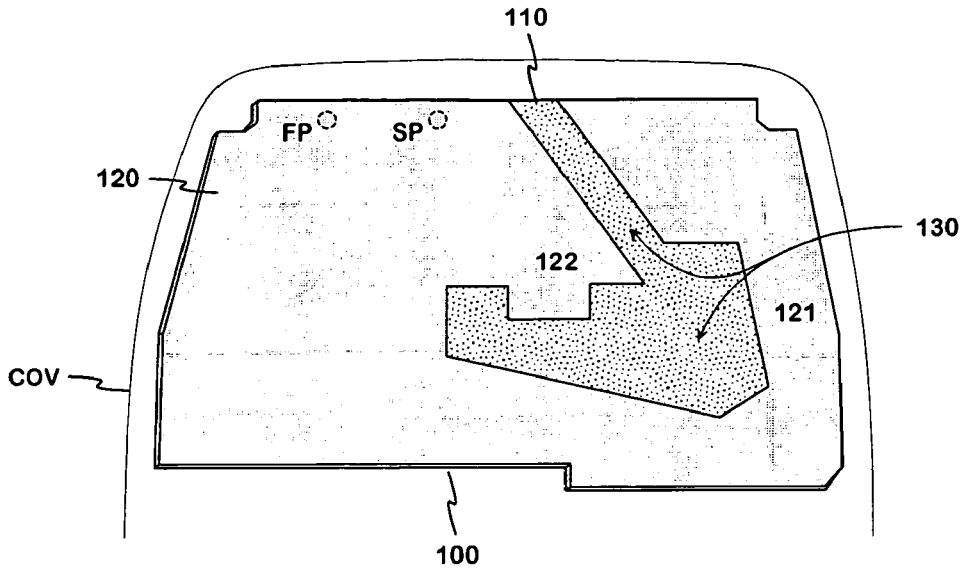
Fig. 1 PRIOR ART
FIG. 1 presents an example of a prior art antenna element.
Figure 2:
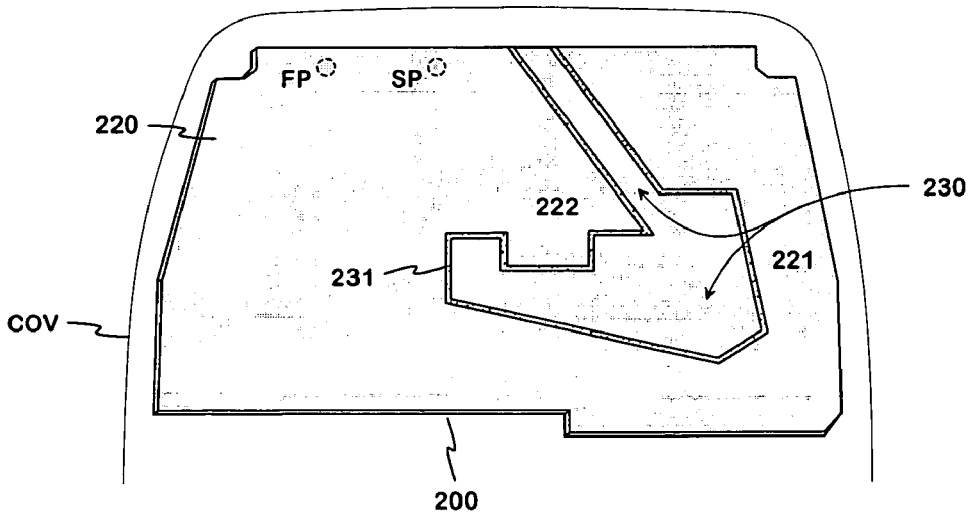
FIG. 2 presents an example of an antenna element according to the invention.

FIG. 2 shows an example of a radiating antenna element according to the invention. The antenna element 200 comprises a dielectric substrate and a radiating plane 220 on its surface, divided into two conductor branches, like in the element of FIG. 1. The elements differ from each other with respect to the area separating the radiating conductor branches. In FIG. 1, the conductive coating has been entirely removed from that intermediate area 130. In FIG. 2 again, the original conductive coating is almost entirely left on the corresponding intermediate area 230. The conductive coating has been only narrowly removed at the border line of the intermediate area. The line-like non-conductive area thus created is called a "groove". So, the intermediate area 230 is confined by a border groove 231. The conductor area remaining inside the border groove, which is slightly smaller than the intermediate area 230, forms in the complete product, in principle, together with the ground plane and the other part of the radiating plane a resonator, in which it is possible to excite oscillation. The element according to FIG. 2 has been dimensioned so that the frequency of said oscillation is considerably above the natural frequencies of the resonators corresponding to the first 221 and also the second 222 conductor branch of the radiating plane. Therefore, the conductor area 223 of the intermediate area does not significantly influence the function of the antenna on its operating bands.

Figure 3:
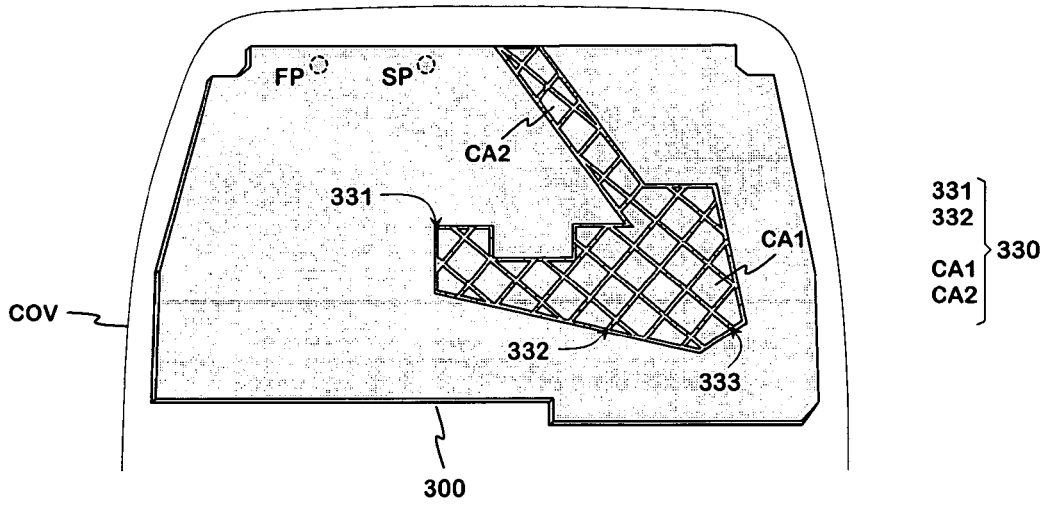
FIG. 3 presents another example of an antenna element according to the invention.

FIG. 3 shows another example of a radiating antenna element according to the invention. The antenna element 300 is of the same kind as the element presented in FIG. 2. The only difference compared to FIG. 2 is that the conductor area remaining inside the border groove 331 of the intermediate area between the radiating conductor branches is now split into smaller parts by grooves forming a lattice pattern. The lattice pattern comprises a set of parallel grooves, such as groove 332, and another set of grooves perpendicular to those mentioned above, such as groove 333. The grooves are here at even distances, and so the small parts of the conductive coating, or pads, separated by the grooves are square-shaped, except of course the pads cut by the border groove. Two pads, CA1 and CA2, are marked in FIG. 3 by reference lines. The pads in the intermediate area are made so small that they are entirely "invisible" at the operating frequencies of the antenna. In that way it has been ensured that the conductive coating of the intermediate area does not radiate or have any significant effect on the electromagnetic coupling between the radiating conductor branches. In this example, the pads are square-shaped. They could as well be rectangles, parallelograms or something else by shape, as long as they are sufficiently small.

Figure 4:
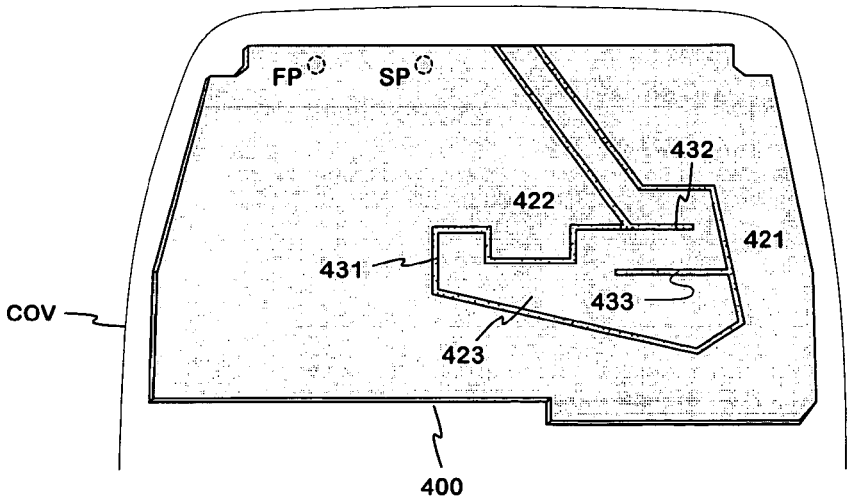
FIG. 4 presents a third example of an antenna element according to the invention.

FIG. 4 shows a third example of a radiating antenna element according to the invention. The antenna element 400 is also of the same kind as the element presented in FIG. 2. The only difference to FIG. 2 is that in this example, two grooves 432 and 433 have been made in the conductor area 423 remaining inside the border groove 431 of the intermediate area of the radiating branches. Those two grooves are joined in the border groove 431 on the opposite sides of the intermediate area, whereby meanders increasing the electric length of the conductor area 423 are formed in it. In this way, the natural frequency of the resonator corresponding to the conductor area 423 can be tuned to the band used by some radio system, such as Bluetooth or GPS (Global Positioning System). The conductor area functions as a parasitic radiator on that band, and is thus utilized in this embodiment.

In all the embodiments of the invention, the conductive coating of the intermediate area between the radiating conductor branches of the antenna element remains almost entirely on place. In practice, removing the entire coating would require the use of the etching technique, which is attempted to be avoided. Etching can naturally also be used merely for forming the border groove and possible other grooves, in which case the resulting component is comformable to the invention. The grooves required can also be made by machining the surface of the element mechanically. However, the best result economically and electrically is achieved by the laser technique, which is thus the primary machining technique for the conductive coating.

Figure 5:
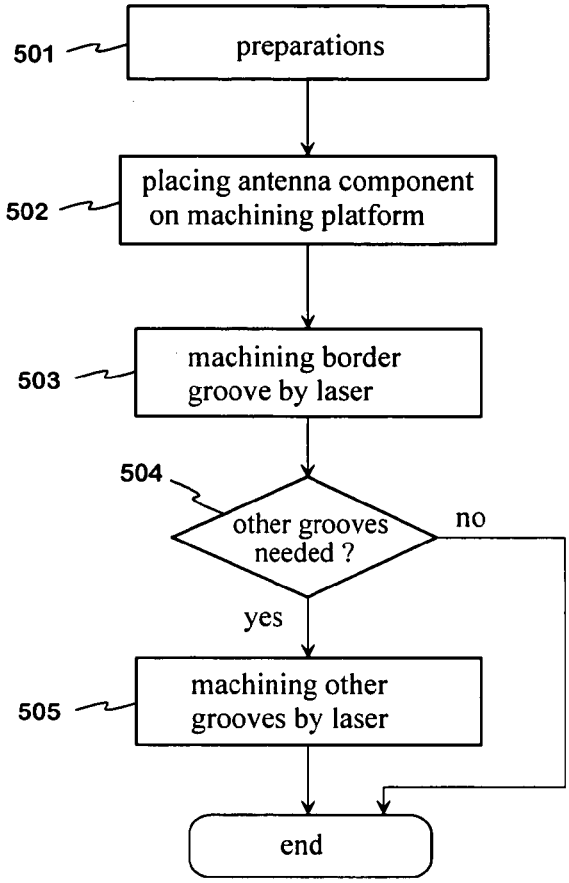
FIG. 5 presents an example of a method according to the invention.

FIG. 5 shows an example of a method according to the invention. In step 501, preparations are made for machining the conductive coating of the antenna element. They include cutting the element to the right shape when a ready-coated substrate plate is used or cutting a mere conductor foil and fastening it to the antenna frame or to a part of the casing of the radio device. In addition, the right program is loaded to the laser machine tool. In step 502, the antenna component is placed on the machining platform of the laser tool. The component can be placed either so that the laser beam falls directly on the conductive coating or the other way round, in which case the laser beam first penetrates the dielectric substrate. Each case requires its own, suitable laser frequency. In step 503, the radiating branches of the antenna component are formed by machining the border groove of the area between them. The border groove is created when the laser beam evaporates the conductor material from a narrow area. In step 504 it is checked whether other grooves are intended to be made on the intermediate area. If so, those grooves are machined in the same way as the border groove (step 505). After this, the component is finished with respect to its radiation characteristics.

Figure 6:
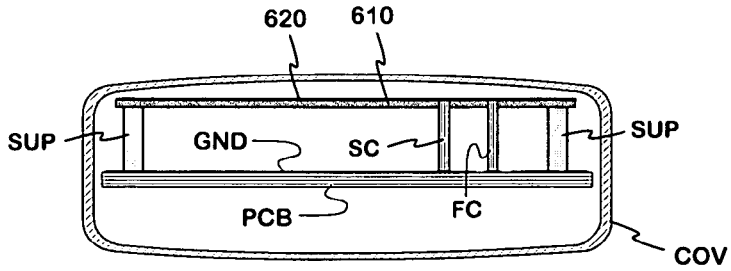
FIG. 6 presents an example of an antenna element according to the invention as installed in a radio device.

FIG. 6 shows an example of an antenna element according to the invention as installed in a radio device. The radio device is presented as a simplified cross-section in which the outer cover COV and the circuit board PCB are seen. The conductive upper surface of the circuit board is of the signal ground GND and also functions as the ground plane of the antenna. The antenna element, which comprises a dielectric substrate 610 and its conductive coating 620, can be made of a thin circuit board, for example. The element is supported above the ground plane by support legs SUP, total amount of which is such as required for the sufficient support. In addition, the figure shows the antenna feed conductor FC and the short-circuit conductor SC.

Figure 7:
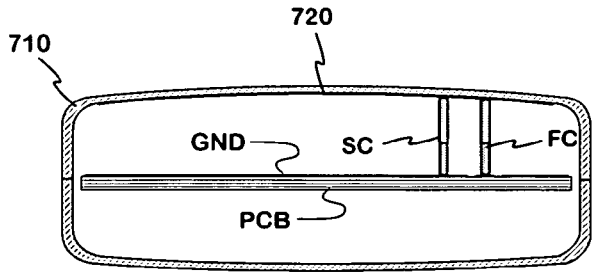
FIG. 7 presents another example of an antenna element according to the invention as installed in a radio device.

FIG. 7 shows another example of an antenna element according to the invention as installed in a radio device. The radio device is also here shown as a simplified cross-section in which the outer cover and the circuit board PCB are seen. The conductive upper surface of the circuit board is of the signal ground GND and also functions as the ground plane of the antenna. In this example, the antenna element is formed of a part 710 of the outer cover of the radio device and a conductor foil 720 fastened to its inner surface by glueing, for example. Said part of the outer cover thus functions as the dielectric substrate of the element. An area between the radiating branches according to the invention is formed on the conductor foil after the foil has been fastened. The antenna feed conductor FC and the short-circuit conductor SC are also seen in FIG. 7.

Figure 8:
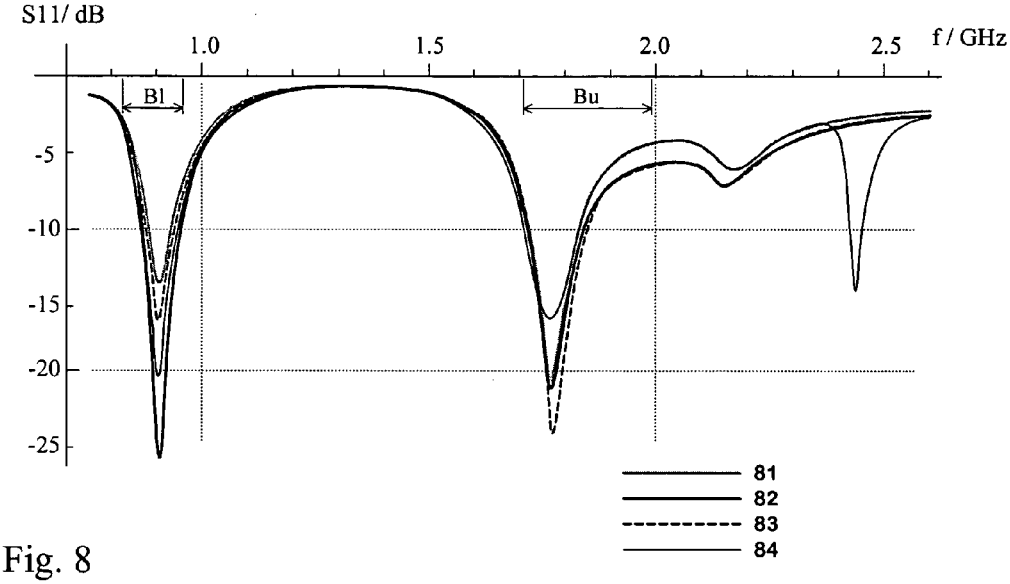
FIG. 8 shows an example of band characteristics of the antennas using an element according to the invention.

FIG. 8 shows an example of band characteristics of the antennas using an element according to the invention. It presents curves of the reflection coefficient S11 as a function of frequency. Curve 81 has been measured from a known antenna using an element according to FIG. 1, curve 82 from an antenna using an element according to FIG. 2, curve 83 of an antenna using an element according to FIG. 3, and curve 84 of an antenna using an element according to FIG. 4. The antenna is designed to operate in the systems GSM850 (Global System for Mobile telecommunications), GSM900, GSM1800 and GSM1900. The bands required by the two former are on the frequency range 824 to 960 MHz, which is the lower operating band BI of the antenna. The bands required by the two latter are on the frequency range 1710 to 1990 MHz, which is the upper operating band Bu of the antenna. The measurements have been performed on prototypes. It is seen from the curves that with a small amount of additional tuning, the reflection coefficient of all the antenna versions is better than −5 dB on the whole area of both operating bands. In addition, it can be seen that leaving conductive coating on the intermediate area between the radiating branches of the antenna does not deteriorate the band characteristics of the antenna, but on the contrary, improves them slightly. In addition, the antenna corresponding to curve 84 and FIG. 4 has been dimensioned to operate on the band of the Bluetooth system, and therefore the reflection coefficient falls deeply above the frequency of 2.4 GHz. The width of the topmost band is almost 100 MHz.

Figure 9:
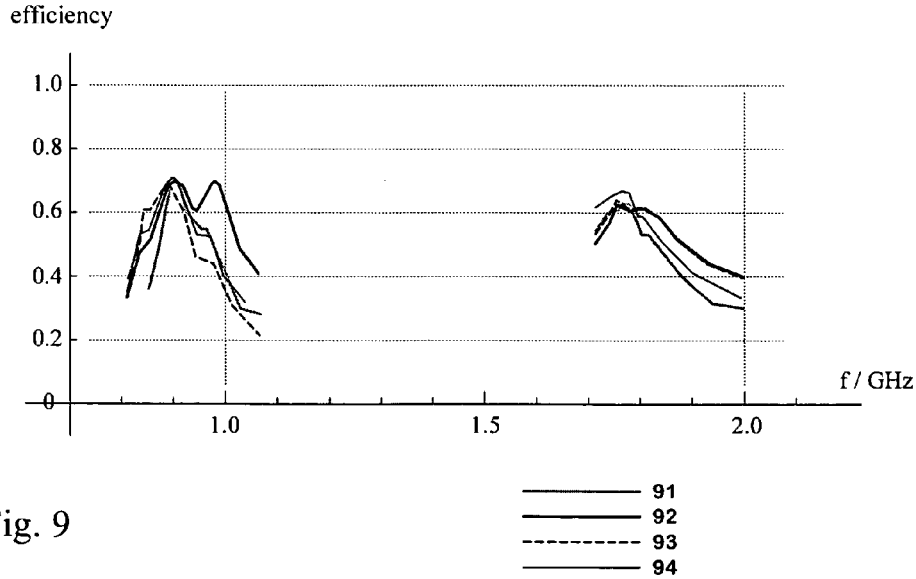
FIG. 9 shows an example of the efficiency of antennas using an element according to the invention.

FIG. 9 shows an example of the efficiency of antennas using an element according to the invention. The efficiencies have been measured from the same structures as the matching curves of FIG. 8: Curve 91 shows the change of the efficiency in a known antenna using an element according to FIG. 1, curve 92 in an antenna using an element according to FIG. 2, curve 93 in an antenna using an element according to FIG. 3 and curve 94 in an antenna using an element according to FIG. 4. On the lower operating band the efficiencies vary in the range 0.3 to 0.7, and on the upper operating band in the range 0.3 to 0.65. With respect to efficiency, the antenna according to the invention, corresponding to FIG. 2, also beats the prior art antenna corresponding to FIG. 1.

The qualifiers "upper" and "lower" in this description and the claims refer to the positions of the antenna element presented in FIGS. 5 and 7 to 9, and they have nothing to do with the position in which the devices are used.

Antenna elements according to the invention have been described above. The shapes of the antenna element and its radiators can naturally differ from those presented. The inventive idea can be applied in different ways within the limits set by the independent claims 1 and 7.

The invention claimed is:

1. A radiating antenna element of a multiband planar antenna, which element comprises a dielectric substrate and conductive coating on one surface of the substrate, which coating has a feed point arranged to be connected to an antenna feed conductor and is divided by an intermediate area into at least first and second radiating conductor branches to form more than one operating band, some of said conductive coating being also located on said intermediate area, separated from the radiating conductor branches by a border groove.

2. An antenna element according to claim 1, the conductive coating covering the whole intermediate area except for said border groove.

3. An antenna element according to claim 1, the conductive coating of the intermediate area being divided into a plurality of separate conductor areas to make sure that the conductive coating of the intermediate area does not radiate or have any substantial effect on a coupling between the radiating conductor branches on the range of the operating bands of the antenna.

4. An antenna element according to claim 1, the conductive coating of the intermediate area being continuous and having at least one groove starting from the border of the area to change the electric length of the conductive coating and to form a parasitic radiator resonating in a certain band.

5. An antenna element according to claim 1, being a discrete component to be installed inside outer cover of a radio device.

6. An antenna element according to claim 1, said dielectric substrate being a part of outer cover of a radio device.

7. A method for manufacturing a radiating antenna element of a multiband planar antenna by removing some of a conductive coating on one surface of a dielectric substrate to form at least first and second radiating conductor branches of the antenna element, wherein said removing of a conductive coating is implemented by machining a border groove of an intermediate area between said conductor branches so that the conductive coating of the intermediate area remains substantially completely left in the antenna element.

8. A method according to claim 7, machining on said conductive coating of the intermediate area, in addition to the border groove, at least one groove joined in the border groove.

9. A method according to claim 7, the machining of the conductive coating of the intermediate area being implemented by laser technique.

10. A radiating antenna element of a multiband planar antenna, which element comprises a dielectric substrate and conductive coating on one surface of the substrate, which coating has been divided by an intermediate area into at least first and second radiating conductor branches to form more than one operating band, some of said conductive coating being also located on said intermediate area, separated from the radiating conductor branches by a border groove;

wherein the conductive coating of the intermediate area is divided into a plurality of separate conductor areas to make sure that the conductive coating of the intermediate area does not radiate or have any substantial effect on a coupling between the radiating conductor branches on the range of the operating bands of the antenna.

* * * * *